US009364121B2

(12) United States Patent
Sprague

(10) Patent No.: US 9,364,121 B2
(45) **Date of Patent: *Jun. 14, 2016**

(54) SLIDING SHOWER DOOR ASSEMBLY

(71) Applicant: C.R. Laurence Co., Inc., Los Angeles, CA (US)

(72) Inventor: Gary Sprague, Los Angeles, CA (US)

(73) Assignee: C. R. LAURENCE CO., INC., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/631,672

(22) Filed: Feb. 25, 2015

(65) Prior Publication Data

US 2015/0164284 A1 Jun. 18, 2015

Related U.S. Application Data

(63) Continuation of application No. 13/659,810, filed on Oct. 24, 2012, now abandoned.

(60) Provisional application No. 61/550,808, filed on Oct. 24, 2011.

(51) Int. Cl.

| | |
|---|---|
| ***A47K 3/34*** | (2006.01) |
| ***E05D 15/06*** | (2006.01) |
| *E06B 3/46* | (2006.01) |

(52) U.S. Cl.

CPC ..... *A47K 3/34* (2013.01); *E05D 15/0652* (2013.01); *E05D 15/0656* (2013.01); *E05D 15/0665* (2013.01); *E05D 15/0686* (2013.01); *E05D 15/0691* (2013.01); *E06B 3/46* (2013.01); *E05Y 2201/614* (2013.01); *E05Y 2800/16* (2013.01); *E05Y 2800/672* (2013.01); *E05Y 2900/00* (2013.01); *E05Y 2900/114* (2013.01); *E06B 3/4636* (2013.01); *E06B 3/4681* (2013.01)

(58) Field of Classification Search

CPC ..... A47K 3/34; A47K 3/362; E05D 15/0665; E05D 15/686; E05D 15/0691

See application file for complete search history.

(56) References Cited

U.S. PATENT DOCUMENTS

| | | | | |
|---|---|---|---|---|
| 1,956,651 A | | 5/1934 | Moran | |
| 2,197,385 A | | 4/1940 | Ricken | |
| 3,167,112 A | | 1/1965 | Morton | |
| 3,310,914 A | | 3/1967 | De Klavon | |
| 3,359,573 A | * | 12/1967 | Casebolt | A47K 3/34 4/607 |

(Continued)

*Primary Examiner* — Gregory Strimbu

(74) *Attorney, Agent, or Firm* — Cislo & Thomas, LLP

(57) ABSTRACT

A fully frameless sliding shower door assembly includes a sliding panel of sufficient strength to be fully self-supporting and includes a stationary panel. The need for an upper horizontal header member is eliminated by using an upper guide assembly having a guide which is fixed to the sliding panel and configured to slide about a top edge of the stationary panel. A self-centering roller assembly is attachable to the sliding panel without the need for a rail member. The roller assembly and a track therefore feature matching inverted and non-inverted generally U-shaped profiles. The shower door assembly further features inboard and outboard roller finger guards, as well as a track leveling feature which improves ease of installation.

26 Claims, 8 Drawing Sheets

(56) References Cited

U.S. PATENT DOCUMENTS

| | | | | | |
|---|---|---|---|---|---|
| 4,014,070 | A | * | 3/1977 | Rifkin | A47K 3/34 16/90 |
| 4,064,592 | A | | 12/1977 | Riegelman et al. | |
| 4,189,870 | A | * | 2/1980 | Helmick | 49/420 |
| 4,365,368 | A | | 12/1982 | Boggs | |
| 4,592,168 | A | | 6/1986 | Struckmeyer | |
| 4,633,615 | A | * | 1/1987 | Moose | 49/425 |
| 4,807,312 | A | | 2/1989 | Baus | |
| 4,878,530 | A | * | 11/1989 | Jean | 160/211 |
| 5,852,837 | A | * | 12/1998 | Husting | A47K 3/34 4/607 |
| 5,908,064 | A | * | 6/1999 | Bruce | 160/202 |
| 5,911,519 | A | * | 6/1999 | Eutebach | 4/607 |
| 7,021,007 | B2 | | 4/2006 | Jacobs | |
| 2007/0062122 | A1 | * | 3/2007 | Polus | 49/425 |
| 2012/0005822 | A1 | * | 1/2012 | Daubmann | A47K 3/34 4/607 |

* cited by examiner

SLIDING SHOWER DOOR ASSEMBLY

CROSS REFERENCE TO RELATED APPLICATIONS

This application claims priority to U.S. Utility application Ser. No. 13/659,810, filed on Oct. 24, 2012, now abandoned which in turn claims priority to U.S. Provisional Application Ser. No. 61/550,808, filed Oct. 24, 2011—the contents of both applications are expressly incorporated herein by reference in their entirety.

BACKGROUND OF THE INVENTION

1. Field of the Invention

The present invention relates generally to sliding shower doors, and, more particularly, to a headerless sliding shower door assembly.

2. Background of the Invention

Most conventional sliding shower door panels are comprised of fully framed translucent panels, where the frames are made from aluminum or other non-rusting metallic material. Fully framed shower door panels, though functional, are undesirable from a manufacturing, as well as an aesthetic point of view. Fully framed shower door panels are undesirable from a manufacturing viewpoint because of the material and labor costs incurred in fabricating and installing the metal frames about the translucent panels. Fully framed shower doors are also undesirable from an aesthetic point of view because unsightly oxidation typically develops on the framing members within a short period of time.

The aesthetic functionality of a shower door may be improved if a method may be devised to eliminate the door frames. Likewise, elimination of the door frames would improve manufacturing efficiency by eliminating material costs and reducing manufacturing operations. Some efforts towards frameless shower doors have been attempted in the art. In particular, shower doors in which the vertical framing members are eliminated have been developed. Such doors, while a step forward in the art, nevertheless typically still retain horizontal framing members such as a lower horizontal rail member and an upper horizontal header member and therefore suffer from all of the drawbacks of fully framed shower doors, albeit to a somewhat lesser degree. Thus, there remains room for improvement in the art.

It is the purpose of the present invention to provide a completely frameless sliding shower door assembly, i.e. an assembly that eliminates not only the vertical framing members of prior art doors, but also the vertical header and rail members as well.

SUMMARY OF THE INVENTION

An exemplary embodiment of the present invention presents a fully frameless sliding shower door assembly. The assembly dispenses with the need for vertical framing members by using door panels of sufficient strength and rigidity to be fully self-supporting. The need for an upper horizontal header member is eliminated by using a unique upper guide assembly where the guide is fixed to a movable shower door panel and configured to slide about a top edge of a stationary or fixed shower door panel. The upper guide assembly, being fixed to the moveable shower door panel and sliding about a top portion of the fixed door panel, therein uses the fixed door panel to provide lateral support for the movable door panel.

The need for a lower horizontal rail member is eliminated by the use of a unique roller assembly that is attachable to the movable door panel without the need for a rail member. One or more of the roller assemblies may be used in the shower door assembly as may be desired depending upon the size of the rollers, weight of the door to be supported, and aesthetic considerations. The roller assembly features an inverted generally U-shaped profile on the roller which engages with a matching, non-inverted generally U-shaped profile on the track. The mating inverted and non-inverted U-shaped profiles on the roller and track, respectively, make the roller self-centering upon the track, and therefore eliminates the need for guide channels formed into the track as is typical of prior art designs. The use of inverted and non-inverted U-shaped surfaces on the roller and track, respectively, also substantially increases the load bearing area of the roller in comparison to prior art designs which typically utilize a semi-circular profile on the roller which engages a flat track. The rollers of the roller assemblies are the primary vertical load carrying members of the sliding shower door assembly, i.e. the rollers support the weight of the movable door panel.

The shower door assembly of the present invention also features a first or Inboard finger guard with an L-shaped cross-section having a vertical flange and a horizontal flange, the inboard finger guard being attached to an inboard side of the roller assembly. (For the purposes of this application, the term "outboard" is defined as facing outwardly from the shower enclosure or on the outside of the movable shower door. Similarly, the term "inboard" is defined to mean facing inwardly of the shower enclosure or on the inside of the movable shower door.) The horizontal flange of the inboard finger guard faces inwardly with respect to the track and is disposed underneath an elevated horizontal flange of the track. The elevated horizontal flange of the track faces outwardly with respect to the vertical flange of the inboard finger guard. This arrangement of an inwardly facing flange on the finger guard which overlaps with an outwardly facing flange on the track fully closes out the roller on its inboard side and therein prevents any possibility of fingers or toes from inadvertently being caught between the roller and the track on the inboard side of the roller.

The shower door assembly of the present invention also features a second or outboard finger guard comprised of an upwardly raised surface on the track which inhibits finger or toe access to the roller on the outboard side of the roller. The finger guards of the present invention serve to prevent fingers and toes from getting caught between the roller and the track and represent an improvement the art because such features appear to be lacking in prior art designs.

Another feature of the present invention is a track leveling feature or device which improves ease of installation. For the movable shower door to move freely, it is important that the track be level. A level track ensures even contact of the roller assembly or assemblies attached to the door and likewise ensures good alignment with abutting walls or door jambs of the shower enclosure. In the exemplary embodiment, the leveling feature comprises a threaded hole for the receipt of a set screw at one end of the track. The set screw is threaded into the hole from an upper surface of the track until the screw bears against the shower enclosure floor surface, or in the case of tub installations, the tub rail surface. Additional tightening of the set screw causes the track to rise at an angle to the floor or tub rail surface and in this manner, the track may be brought to horizontal level with respect the floor or tub rail surface, thereby substantially easing installation of the shower door assembly.

The above and other features of the invention will become more apparent from the following detailed description.

DETAILED DESCRIPTION OF THE PREFERRED EMBODIMENTS

The present invention will now be described more fully hereinafter with reference to the accompanying drawings, in which preferred embodiments of the invention are shown. The invention may, however, may be embodied in many different forms and should not be construed as being limited to the embodiments set forth herein. Rather these embodiments are provided so that this disclosure will be thorough and complete, and will fully convey the scope of the invention to those skilled hi the art. Like numbers refer to like elements throughout.

Figure 1:
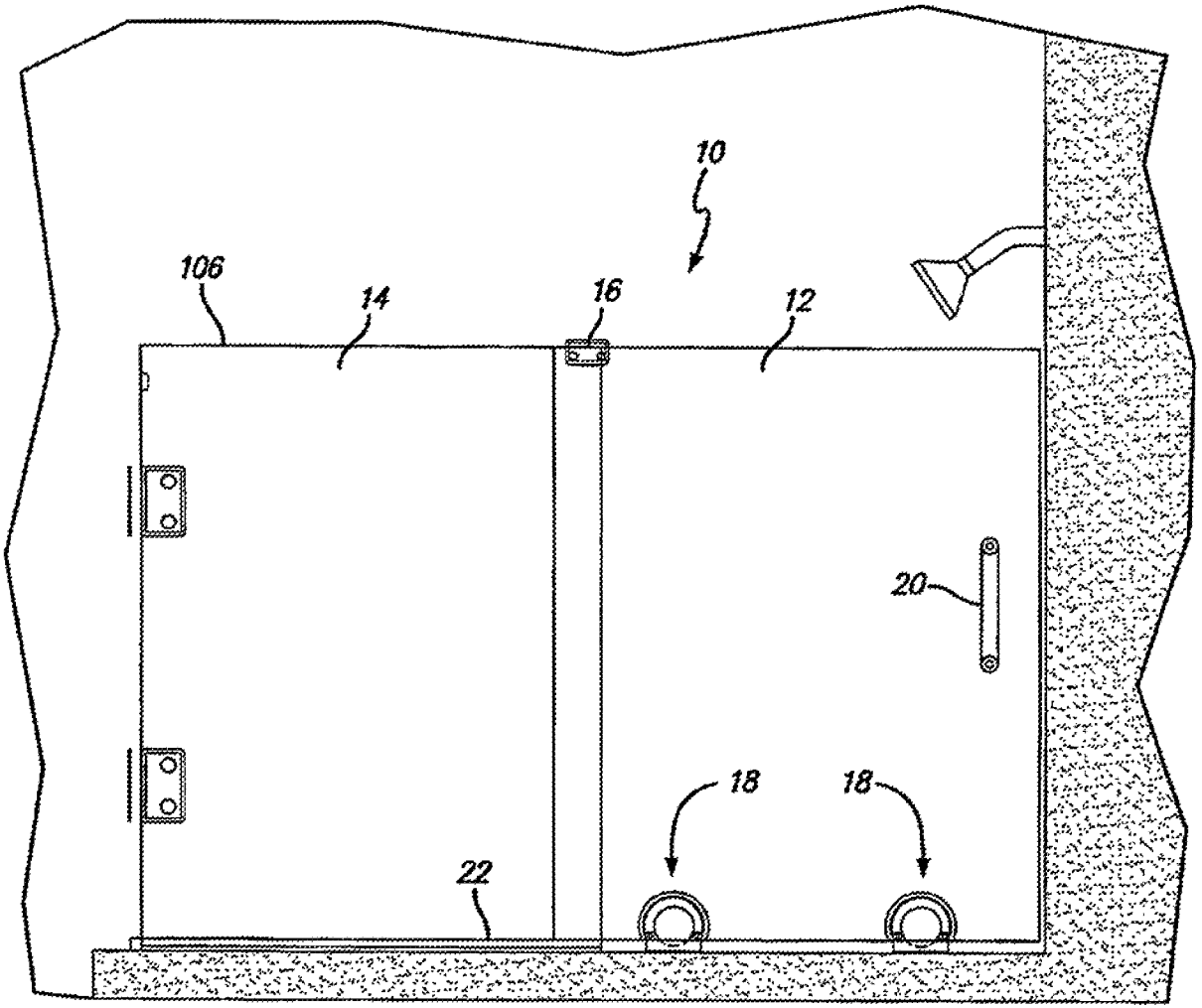
FIG. 1 is a front view of a sliding shower door assembly in accordance with an exemplary embodiment of the present invention.
Figure 2:
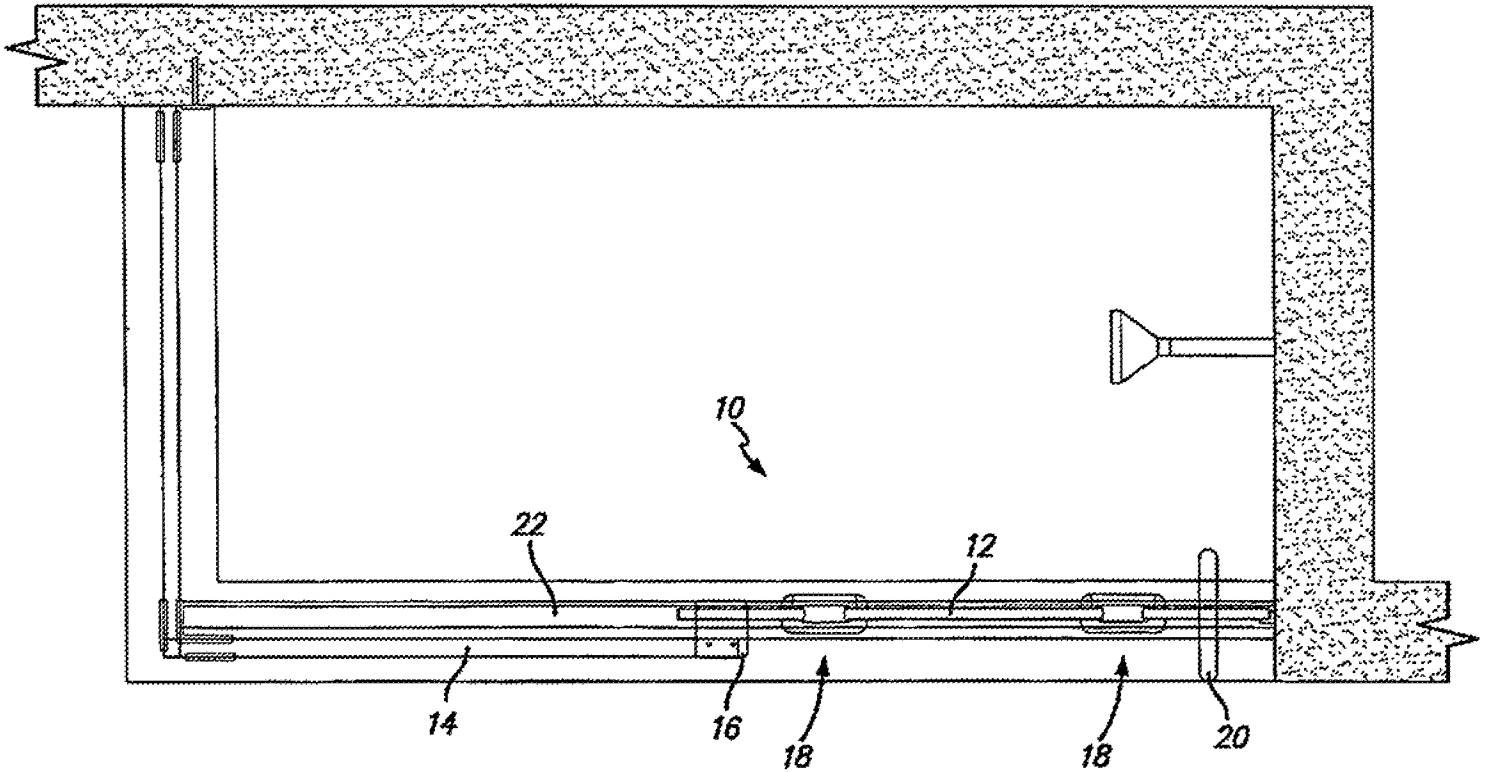
FIG. 2 is top view of the sliding shower door assembly of FIG. 1.
Figure 3:
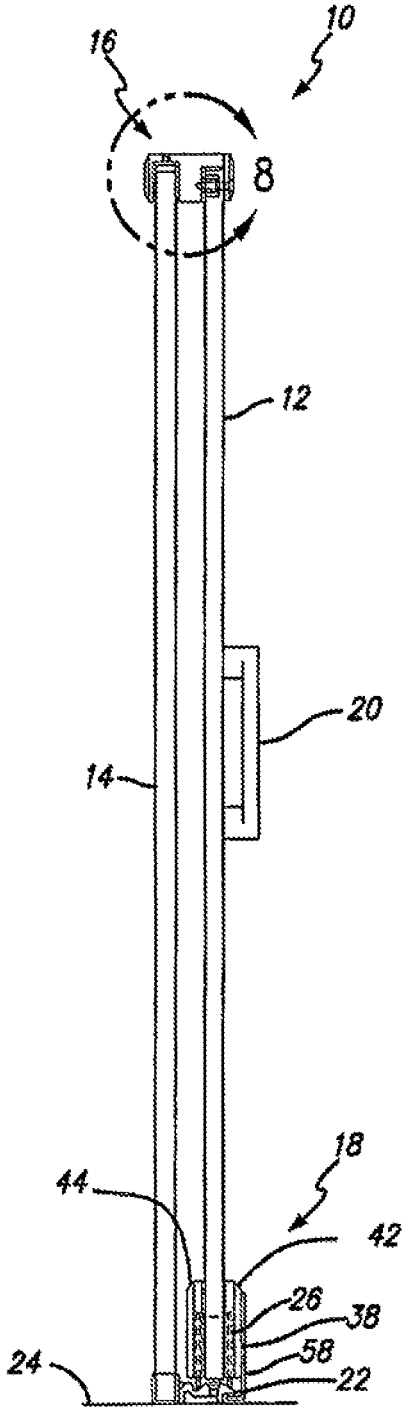
FIG. 3 is side view of the sliding shower door assembly of FIG. 1.

With reference to FIGS. 1 through 3, a sliding shower door assembly 10 in accordance with an exemplary embodiment of the present invention is shown. The shower door assembly 10 comprises a movable door panel 12, a fixed door panel 14, an upper guide assembly 16, one or more roller assemblies 18, and a track 22. The track 22 is mounted on a mounting surface 24. The mounting surface 24 will typically be either the floor of a shower enclosure or the top surface of a tub in the case of bathtub/shower installations. The movable door panel 12 will typically also be equipped with a handle 20. In a typical installation, the movable door panel 12 will be equipped with two roller assemblies 18 and one upper guide assembly 16.

With reference to FIGS. 3.6, the roller assembly 18 of the shower door assembly 10 includes a roller 26. The roller 26 is generally cylindrical having a diameter 30 (see FIG. 4) and a width 28 (see FIG. 5). The diameter 30 and width 28 of the roller 26 may be scaled as needed to support the weight of the movable door panel 12 which may vary depending upon the materials chosen for the door panel's construction and the size of the door panel which may vary depending upon the requirements of any particular installation.

The roller 26 features an inverted U-shaped groove or rolling surface 32 which mates with a U-shaped rolling surface 34 formed on the track 22. The rolling surface 32 of the roller 26 and the rolling surface 34 of the track 22 are of generally the same radius of curvature to facilitate smooth rolling contact between the two rolling surfaces 32 and 34. The U-shaped rolling surface 34 of the track 22 and the mating inverted U-shaped rolling surface 32 of the roller 26 function to keep the roller 26 centered on the track 22 during opening and closing movement of the movable door panel 12 without the need for guide channels or other guiding or roller capturing features in the track. The radius of curvature of the rolling surfaces 32 and 34 may vary but should be sufficiently deep to self-center the roller 26 on the track 22. Experimentation has shown that a radius of curvature within the range of about ½" to about ⅝" to be suitable for most typical applications. The roller further includes a bore 36 for slip-fit receipt of an axle 38.

Figure 5:
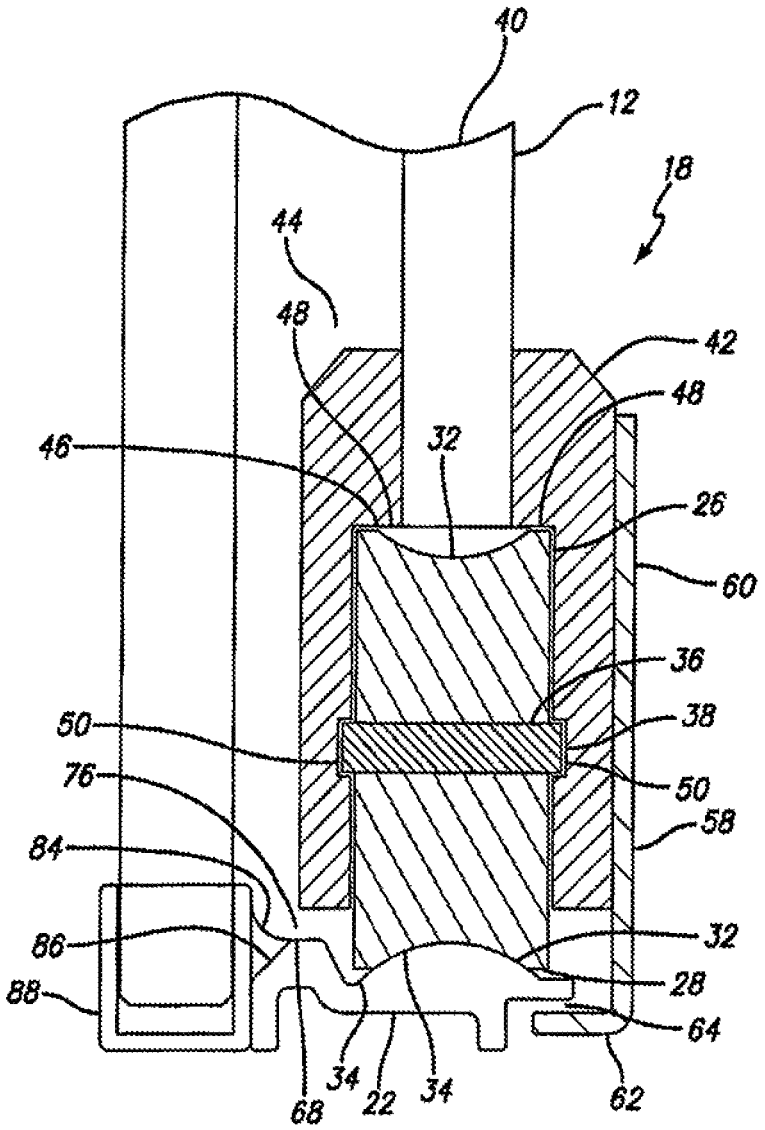
FIG. 5 is an enlarged, partial sectional view of the roller assembly of the sliding shower door assembly of FIG. 4, taken along the line 5-5.

In typical installations, the roller 26 will be generally centered with respect to a thickness 40 of the movable door panel 12, as illustrated in FIG. 5. Typically, the width 28 of the roller 26 will exceed the thickness 40 of the movable door panel 12. To support and center the roller 26 within the movable door panel 12, inboard and outboard roller clamping plates 42 and 44, respectively are provided. The inboard and outboard roller clamping plates 42 and 44 are sized such that when the clamping plates 42 and 44 are affixed to the movable door panel 12, the clamping plates have a combined interior width 46 (see FIG. 5) slightly in excess of that of the roller 26, to allow for free movement of the roller 26 within the inboard and outboard clamping plates 42 and 44. The combined interior width 46 comprises the thickness 40 of the movable door panel 12 and a relieved interior width 48 of each of the inboard and outboard roller clamping plates 42 and 44. (See FIG. 5.) Each of the roller clamping plates 42 and 44 also includes a blind-bore 50 which is sized to receive the axle 38 of the roller 26.

Figure 4:
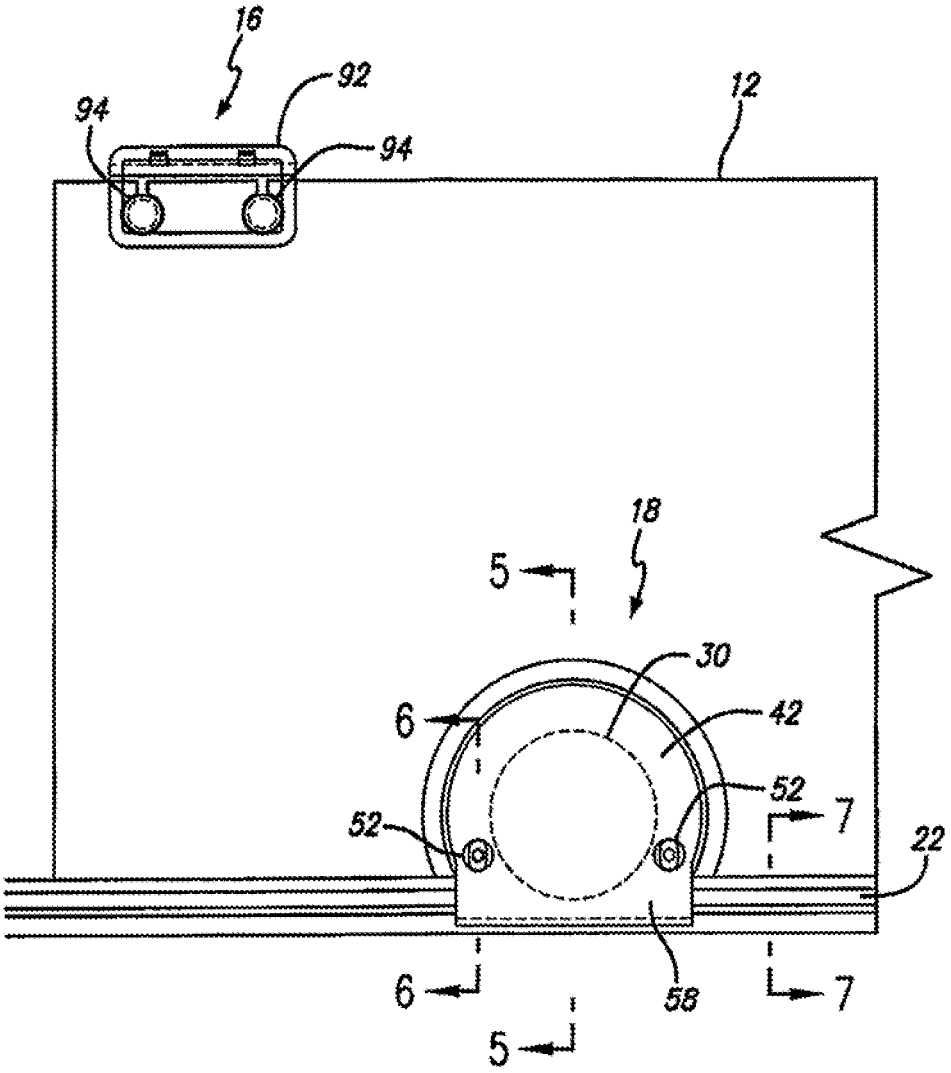
FIG. 4 is an enlarged partial front view of the sliding shower door assembly of FIG. 1.
Figure 6:
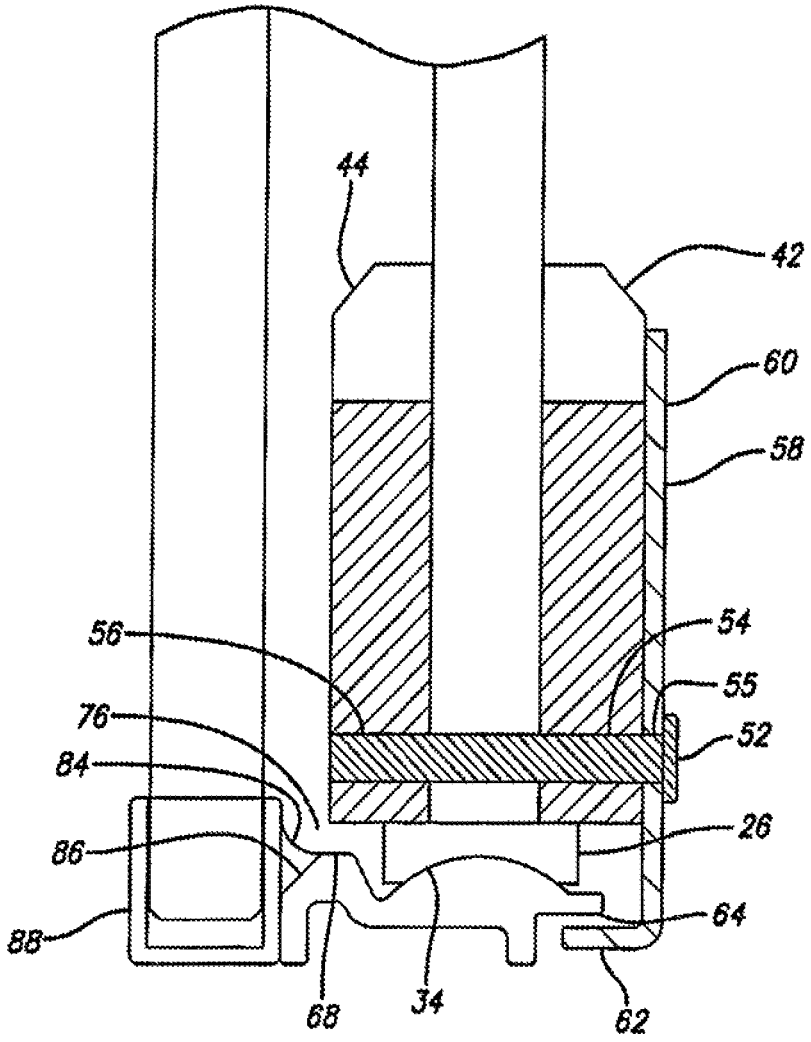
FIG. 6 is an enlarged, partial sectional view of the roller assembly of the sliding shower door assembly of FIG. 4, taken along the line 6-6.

With reference to FIGS. 4 and 6, the roller clamping plates 42 and 44 are attached to the movable door 12 by means of fasteners 52. For each roller assembly 18, two fasteners 52 are used, with one fastener 52 being positioned on each side of the roller 26, as illustrated in FIG. 4. Each fastener 52 passes through a through-bore 54 in the inboard roller clamping plate 42 and is affixed to a blind-bore 56 in the outboard roller clamping plate 44. Each fastener 52 may be affixed to the blind-bore 56 of the outboard roller clamping plate by a number of means. A press fit, threaded engagement, or the use of adhesives are all suitable means for securing the fasteners 52 to the blind-bores 56 of the outboard clamping plate 44. Generally, two fasteners 52 per roller assembly 18 are sufficient to secure the roller assembly to the movable door panel 12. The means for attaching the roller assemblies 18 to the movable door panel 12 eliminate the need for any lower horizontal rail member attached to the movable door panel 12 in the sliding shower door assembly 10 of the present invention.

The inboard and outboard roller clamping plates 42 and 44 are shown in the exemplary embodiment as having a generally semicircular shape with a beveled surface. This configuration was chosen for its pleasing aesthetic appearance. Other shapes having the utilitarian features discussed herein are also suitable.

With continued reference to FIGS. 4-6, the roller assembly 18 may further include a first or inboard finger guard 58. The inboard finger guard 58 features an L-shaped cross-section having a vertical flange 60 and a lower horizontal flange 62. The inboard finger guard 58 is affixed to the inboard roller clamping plate 42 and configured such that the lower horizontal flange 62 is positioned underneath and overlaps an elevated horizontal flange 64 of the track 22. That is the lower horizontal flange 62 of the inboard finger guard 58 faces inwardly towards the track 22 and is disposed underneath and overlaps with the elevated horizontal flange 64 of track, which faces outwardly towards the vertical flange 60 of the inboard finger guard. (See FIGS. 5 and 6.) Via this arrangement, the inboard finger guard 58 extends below the roller 26 and fully closes out the roller 26 on its inboard side and therein prevents any possibility of appendages such as fingers or toes from inadvertently being caught between the roller 26 and the track 22 on the inboard side of the roller assembly 18. Through-bores 55 formed in the inboard finger guard 58 are configured to align to with the through-bores 54 of the inboard roller clamping plate and therein allow the inboard finger guard 58 to be attached to the inboard roller clamping plate 42 via the fasteners 52.

Figure 7:
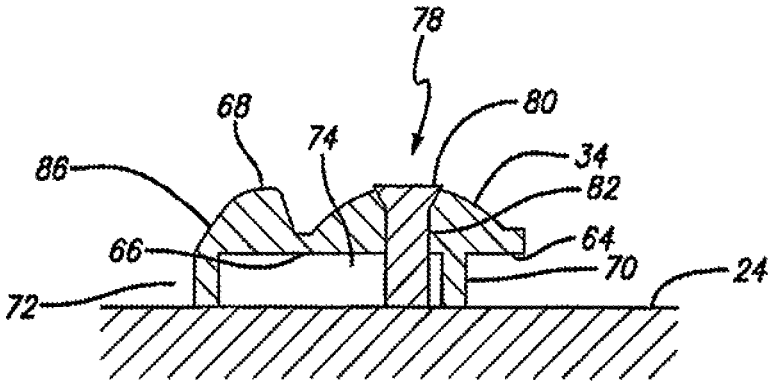
FIG. 7 is an enlarged, partial sectional view of the track of the sliding shower door assembly of FIG. 4, taken along the line 5-5.

With reference to FIGS. 5-7, the track 22 of the sliding shower door assembly 10 of the present invention is an extrusion of complex cross-section. The track 22 features a mid-surface 66. Extending downwardly from the mid-surface 66 is an inboard lower wall 70 and an outboard lower wall 72 which form a channel 74 therebetween. Extending from the inboard lower wall 70 is the elevated horizontal flange 64. Extending upwardly from the mid-surface 66 are the U-shaped rolling surface 34 and a second or outboard finger guard 68 in the shape of an upwardly raised truncated V-shaped surface. The outboard finger guard 68 is sized such that a gap 76, (see FIG. 5), between the outboard finger guard 68 and the outboard roller clamping plate 44 is sufficiently small to prevent fingers and toes from extending through the gap.

The inboard 58 and outboard 68 finger guards of the present invention serve to prevent fingers and toes from getting caught between the roller 26 and the track 22 and represent an improvement in the art as such features are often lacking in prior art designs.

With reference to FIG. 7, another feature of the present invention sliding shower door assembly 10 is a track leveling feature 78 which improves the ease of installation of the track 22. For the movable shower door panel 12 to move freely, it is important that the track 22 be level with respect to the track mounting surface 24. The mounting surface 24 may be either the floor in the case of a standalone shower enclosure or may be a tub rail surface in the case of a bathtub/shower installation. A track 22 which is level ensures even contact of the roller assemblies 18 attached to the movable door panel 12 with the track 22 and likewise ensures good alignment with abutting walls or door jambs of the shower enclosure. Typically, two roller assemblies 18 will be used on the movable shower door panel 12.

In the exemplary embodiment, the track leveling feature 78 comprises a hole 82 which is threaded for the receipt of a set screw 80. Typically, each track 22 will include a single leveling feature 78, i.e. threaded hole 82 and set screw 80, located at one end of the track. During installation, the set screw 80 is threaded into the hole 82 from the U-shaped rolling surface 34 of the track 22 until the screw bears against the track mounting surface 24. Additional tightening of the set screw 80 causes the track 22 to rise at an angle to the mounting surface 24 and in this manner, the track 22 may be brought to horizontal level with respect the mounting surface 24, thereby substantially easing installation of the shower door assembly 10.

With reference to FIGS. 5 and 6, in some installations, it may be desirable to include water proof sealing material 84 between an outboard sealing surface 86 of the track 22 and a base end or rail 88 of the fixed panel 14 of the sliding shower door assembly 10. The sealing material 84 serves to prevent water infiltration past the base rail or end 88 of the fixed door 14.

Figure 8:
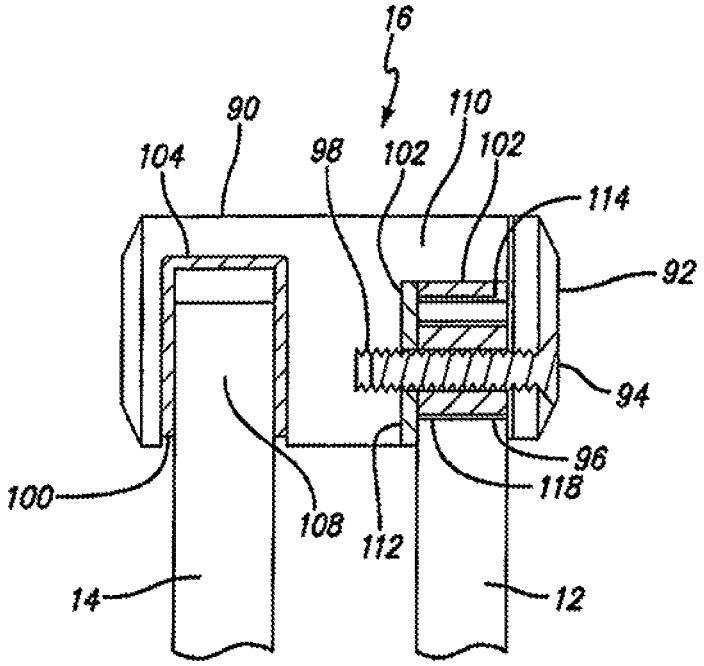
FIG. 8 is an exploded partial sectional view of the sliding shower door assembly of FIG. 3, showing a guide assembly for supporting a movable shower door relative a stationary shower door, wherein the guide assembly is fixed to the movable shower door and slides over an upper portion of the stationary shower door.

With reference to FIG. 8, the upper guide assembly 16 of the sliding shower door assembly 10 of the present invention is shown in more detail. The upper guide assembly 16 is fixed to the movable shower door panel 12 and configured to slide about a top portion 108 of the stationary shower door panel 14. Therefore, the upper guide assembly 16, being fixed to the moveable shower door panel 12, travels with the movable door panel as it is opened and closed. This arrangement allows the fixed door panel 14 to provide lateral support to the movable door panel 12 and therein eliminates the need for an upper horizontal header member as is typical of prior art designs.

The upper guide assembly 16 includes a guide block 90. The guide block 90 includes on its outboard side a channel 104. The channel 104 is configured to be slidable along a horizontal length 106 (see FIG. 1) of a top portion 108 of the fixed door panel 14. The channel 104 of the guide block 90 may optionally include an inner guide liner 100 which may be made from a low friction material and which may be replaced as a wear item. On its inboard side, a vertical wall 112 and a horizontal wall 114 of the guide block 90, in conjunction with a guide clamp plate 92, form a channel 110. The movable door panel 12 is clamped to the guide block 90, within the channel 110, via clamp screws 94. (See FIGS. 1 and 8.) The heads of the clamp screws 94 bear against the clamp plate 92 whereas the threaded ends of the clamp screws thread into threaded blind-bores 98 in the guide block 90. Alternative fasteners such as press fit pins may be substituted for the clamp screws 94. Compression gaskets 102 may also be optionally included within the channel 110 to more uniformly distribute the clamping pressure generated by the clamp screws 94. Optionally, bushings 96 set into the movable door 12 may be used to prevent the shank of the clamp screws 94 from bearing directly against the material of the sliding door panel 12.

Figure 9:
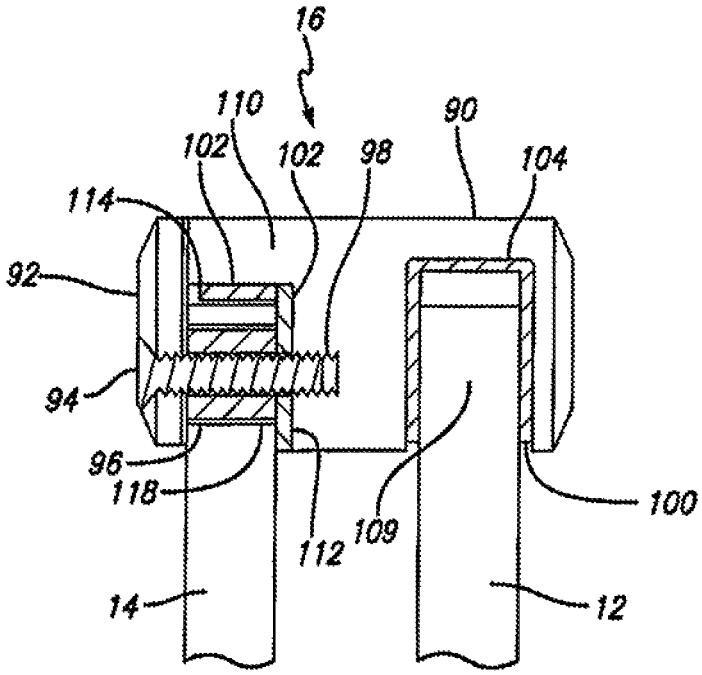
FIG. 9 is an exploded partial sectional view of the sliding shower door assembly of FIG. 3, showing a guide assembly for supporting a movable shower door relative a fixed shower door, wherein the guide assembly is fixed the stationary shower door and slides over an upper portion the movable shower door.

With reference to FIG. 9, in an alternative embodiment, the orientation of the upper guide assembly 16 may be reversed from that shown in FIG. 8. In the embodiment shown in FIG. 8, described above, the upper guide assembly 16 is fixed to the movable shower door panel 12 and slides about a top portion 108 of the stationary shower door panel 14. In this arrangement, the upper guide assembly 16 travels with the movable shower door panel 12.

In the reverse configuration shown in FIG. 9, the upper guide assembly 16 is fixed to the stationary shower door panel 14 and is slidably engaged with the movable shower door panel 12, i.e. the guide block 90 is fixed to the stationary shower door panel 14 via the guide clamp plate 92 and clamp screws 94 and the channel 104 of the guide block 90 is slidably engaged with an upper portion 109 of the movable shower door panel 12. In this configuration, the upper guide assembly 16 being fixed to the stationary shower door panel 14 remains fixed during movement of the movable shower door panel 12 which slides within the channel 104 of the guide block 90 when the movable shower door panel 12 is opened and closed.

Both of the upper guide assembly 16 configurations described above will provide sufficient lateral support to the movable door panel 12, however the configuration of FIG. 8 where the upper guide assembly 16 is fixed to the movable shower door panel 12 and slides about an upper portion 108 of the stationary shower door panel 14 is advantageous in that the movable shower door panel 12 will remain erect in the (unlikely) event that the movable door panel 12 were to derail during use.

The sliding shower door assembly 10 of the present invention is not limited to any particular choice of materials. A number of materials for each component of the assembly 10 are suitable and are known in the art. For example, the movable and fixed door panels 12 and 14 will typically be made of a relatively lightweight material that is sufficiently strong to be fully self-supporting for the purpose of eliminating any need to frame the door panels. Presently, translucent or transparent materials are preferred for shower doors in residential home installations. A variety of rigid translucent polycarbonate and acrylic materials including Lucite and Plexiglass are suitable. Opaque plastic and metallic materials are also suitable. Treated wood materials may also be suitable.

The roller assembly or assemblies 18 will typically be made from metallic materials, with stainless steel and aluminum often being preferred for aesthetic reasons. Structural plastic materials however, are also suitable. The track 22 will typically be a metallic or plastic extrusion. The upper guide assembly 16 will typically be made from plastic materials. Metallic materials are also suitable.

With reference to FIGS. 1-8, the sliding shower door 10 assembly of the present invention will typically be assembled as follows: The fixed door panel 14 will first be set into a shower enclosure as is known in the art. The track 22 will then be set into the floor of the shower enclosure using materials known in the art. The track 22 may be leveled with respect to the track mounting surface 74 using the track leveling feature 78 of the present invention. Typically, the track leveling feature 78 will be located on one end of the track 22. Raising or lowering the set screw 80 of the track leveling feature 78 will raise or lower the track 22 at that end. In this manner the track may brought to a horizontal level condition.

After the track 22 has been leveled, the roller assemblies 18 may be installed. To install each roller assembly 18 in the movable door panel 12, first the axle 38 will be fitted into the roller 26. The roller 26 containing the axle 38 is then fitted into an opening for receipt of the roller 26 in the movable door panel 12. The inboard and outboard roller clamping plates 42 and 44 are then placed on inboard and outboard faces of the movable door panel 12 and positioned such that ends of the axle 38 are located within the blind-bores 50 of the roller clamping plates 42 and 44, and the through-bores 54 of the inboard roller clamping plate 42 are aligned with the blind-bores 56 of the outboard roller clamping plate 44.

Thereafter, inboard finger guard 58 is positioned on the inboard roller clamping plate 42 and the through-bores 55 of the inboard finger guard 58 are aligned with the through-bores 54 of the inboard roller clamping plate 42. Subsequently, the fasteners 52 are installed to thereby secure the roller clamping plates 42 and 44, and consequently the roller assembly 18, to the movable door panel 12. In a typical installation, the movable door panel 12 will include two roller assemblies 18.

Upon attachment of the roller assemblies 8 to the movable door panel 12, the movable door panel is engaged with the track 22 by sliding an outboard side of the movable door panel 12 about the track 22 such that the inverted U-shaped rolling surfaces 32 of the rollers 26 engages with the U-shaped rolling surface 34 of the track 22.

Upon engagement of the roller assemblies 18 of the movable door panel 12 to the track 22, the upper guide assembly 16 is installed to provide lateral support to the movable door panel 12. The upper guide assembly 18 is installed by first positioning the channel 104 of the guide block 90 about the upper portion 108 of the fixed door panel 14. Thereafter, an upper portion 116 of the movable door panel 12 is set against the vertical wall 112 of the guide block 90. The bushings 96 are then placed in holes 118, (see FIG. 8), for receipt of the bushings 96 formed in the upper portion 116 of the movable door panel 12. Guide clamp plate 92 is then aligned with the holes in the bushings 96 and placed on the guide block 90 and movable door panel 12. Thereafter, the clamp screws 94 are installed which upon installation secure the upper guide assembly 16 to the movable door panel 12.

If used, the optional inner guide liner 100 will be installed in the channel 104 of the guide block 90 prior to positioning the channel 104 of the guide block 90 about the upper portion 108 of the fixed door panel 14. Similarly, if used, the optional compression gaskets 102 will be installed on the vertical wall 112 and the horizontal wall 114 of the guide block 90 prior to installation of the movable door panel 12 to the guide block 90. Upon installation of the upper guide assembly 16, the sliding shower door assembly 10 of the present invention is completed.

The foregoing detailed description and appended drawings are intended as a description of the presently preferred embodiment of the invention and are not intended to represent the only forms in which the present invention may be constructed and/or utilized. Those skilled in the art will understand that modifications and alternative embodiments of the present invention which do not depart from the spirit and scope of the foregoing specification and drawings, and of the claims appended below are possible and practical. It is intended that the claims cover all such modifications and alternative embodiments.

The invention claimed is:

1. A sliding shower door assembly, comprising:

a fixed door panel and a frameless movable door panel;

a roller assembly, the roller assembly being attached to a lower portion of the movable door panel, the roller assembly including a roller having a concave rolling surface;

a track, the track having a convex rolling surface;

wherein the concave rolling surface of the roller engages with the convex rolling surface of the track;

an upper guide assembly, the upper guide assembly comprising a guide block and a clamp assembly, the clamp assembly securing the guide block to the frameless movable door panel, the guide block further including a channel, wherein the fixed door panel is slidably received within the channel;

wherein the upper guide assembly moves with the frameless movable door panel and slides along a portion of the fixed door panel;

first and second guards on opposite sides of the roller, wherein the first and second guards prevent a user's fingers and toes from inadvertently being caught between the roller and the track;

wherein the first guard has an L-shaped cross-section comprising a vertical flange and a horizontal flange wherein the vertical flange is attached to the roller assembly and the horizontal flange is positioned below the roller and underneath an elevated horizontal flange of the track; and wherein the second guard comprises a raised surface formed on the track.

2. The sliding shower door assembly of claim 1, wherein the convex rolling surface of the track and the concave rolling surface of the roller each has a radius of curvature of about ½" to about ⅝".

3. The sliding shower door assembly of claim 1, wherein the track further includes a track leveling device.

4. The sliding shower door assembly of claim 3, wherein the track leveling device is located at one end of the track and comprises a single set screw engaged within a threaded hole in the track, wherein the set screw engages with a track mounting surface and wherein clockwise and counter-clockwise rotation of the set screw relative to the track raises or lowers the one end of the track relative to the track mounting surface.

5. The sliding shower door assembly of claim 1, wherein the roller assembly further comprises inboard and outboard roller clamping plates, the inboard and outboard roller clamping plates disposed on inboard and outboard sides of the roller, respectively, the inboard and outboard roller clamping plates each having a bore for receipt of an axle therein, the axle disposed within the roller, wherein the axle extends outwardly beyond the roller and into the bores in the inboard and outboard roller clamping plates.

6. The sliding shower door assembly of claim 5, wherein the roller assembly includes fasteners for attaching the inboard and outboard roller clamping plates on opposing faces of the frameless movable door panel.

7. A sliding shower door assembly, comprising:

a fixed door panel and a frameless movable door panel;

a roller assembly, the roller assembly being attached to a lower portion of the movable door panel, the roller assembly including a roller having a concave rolling surface;

a track, the track having a convex rolling surface;

wherein the concave rolling surface of the roller engages with the convex rolling surface of the track; and an upper guide assembly, the upper guide assembly slidably interconnecting the frameless movable door panel and the fixed door panel, wherein the frameless movable door panel is movable relative to the fixed door panel; and wherein the upper guide assembly comprises a guide block and a clamp assembly, the clamp assembly securing the guide block to the frameless movable door panel, the guide block further including a channel, wherein the fixed door panel is slidably received within the channel.

8. The sliding shower door assembly of claim 7, wherein a first guard is attached to the roller assembly on a first side of the roller assembly, wherein the first guard extends below the roller and prohibits a user's fingers and toes from contacting the roller.

9. The sliding shower door assembly of claim 8, wherein the first guard has an L-shaped cross-section comprising a vertical flange and a horizontal flange wherein the vertical flange is attached to the roller assembly and the horizontal flange is positioned below the roller and underneath an elevated horizontal flange of the track.

10. The sliding shower door assembly of claim 8, wherein the sliding shower door assembly includes a second guard, the second guard comprising a raised surface formed on the track.

11. The sliding shower door assembly of claim 10, wherein the second guard is disposed on a second side of the roller assembly opposite the first side of the roller assembly.

12. The sliding shower door assembly of claim 7, wherein the track further includes a track leveling device.

13. The sliding shower door assembly of claim 12, wherein the track leveling device is located at one end of the track and comprises a single set screw engaged within a threaded hole in the track, wherein the set screw engages with a track mounting surface and wherein clockwise and counter-clockwise rotation of the set screw relative to the track raises or lowers the one end of the track relative to the track mounting surface.

14. The sliding shower door assembly of claim 7, wherein the convex rolling surface of the track and the concave rolling surface of the roller each has a radius of curvature of about ½" to about ⅝".

15. The sliding shower door assembly of claim 7, wherein the roller assembly further comprises inboard and outboard roller clamping plates, the inboard and outboard roller clamping plates disposed on inboard and outboard sides of the roller, respectively, the inboard and outboard roller clamping plates each having a bore for receipt of an axle therein, the axle disposed within the roller, wherein the axle extends outwardly beyond the roller and into the bores in the inboard and outboard roller clamping plates.

16. The sliding shower door assembly of claim 15, wherein the roller assembly includes fasteners for attaching the inboard and outboard roller clamping plates on opposing faces of the frameless movable door panel.

17. The sliding shower door assembly of claim 7, wherein the fixed and frameless movable door panels are made from a self-supporting material.

18. A sliding shower door assembly, comprising;

a fixed door panel and a frameless movable door panel;

a roller assembly, the roller assembly being attached to a lower portion of the movable door panel, the roller assembly including a roller having a concave rolling surface;

a track, the track having a convex rolling surface;

wherein the concave rolling surface of the roller engages with convex rolling surface of the track;

an upper guide assembly, the upper guide assembly slidably interconnecting the frameless movable door panel and the fixed door panel;

wherein the upper guide assembly comprises a guide block and a clamp assembly, the clamp assembly securing the guide block to the frameless movable door panel, the guide block further including a channel, wherein the fixed door panel is slidably received within the channel; and a first guard and a second guard on opposite sides of the roller assembly, wherein the guards prevent a user's fingers and toes from inadvertently being caught between the roller and the track.

19. The sliding shower door assembly of claim 18, wherein the first guard is attached to the roller assembly on a side of the roller assembly, wherein the first guard extends along a side of the track and below the roller.

20. The sliding shower door assembly of claim 18, wherein the first guard has an L-shaped cross-section comprising a vertical flange and a horizontal flange wherein the vertical flange is attached to the roller assembly and the horizontal flange is positioned below the roller and underneath an elevated horizontal flange of the track.

21. The sliding shower door assembly of claim 18, wherein the second guard comprises a raised surface formed on the track.

22. The sliding shower door assembly of claim 18, wherein the track further includes a track leveling device.

23. The sliding shower door assembly of claim 22, wherein the track leveling device is located at one end of the track and comprises a single set screw engaged within a threaded hole in the track, wherein the set screw engages with a track mounting surface and wherein clockwise and counter-clockwise rotation of the set screw relative to the track raises or lowers the one end of the track relative to the track mounting surface.

24. The sliding shower door assembly of claim 18, wherein the convex rolling surface of the track and the concave rolling surface of the roller each has a radius of curvature of about ½" to about ⅝".

25. The sliding shower door assembly of claim 18, wherein the roller assembly further comprises inboard and outboard roller clamping plates, the inboard and outboard roller clamping plates, disposed on inboard and outboard sides of the roller, respectively, the inboard and outboard roller clamping plates each having a bore for receipt of an axle therein, the axle disposed within the roller, wherein the axle extends outwardly beyond the roller and into the bores in the inboard and outboard roller clamping plates.

26. The sliding shower door assembly of claim 25, wherein the roller assembly includes fasteners for attaching the inboard and outboard roller clamping plates on opposing faces of the frameless movable door panel.

* * * * *